US007601902B1

(12) United States Patent
Lombardi

(10) Patent No.: US 7,601,902 B1
(45) Date of Patent: Oct. 13, 2009

(54) MULTI-PIVOTED PEDAL DRUM BEATING APPARATUS

(75) Inventor: Donald G. Lombardi, Westlake Village, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 12/157,130

(22) Filed: Jun. 9, 2008

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 3,677,128 A * 7/1972 Simpson ..... 84/422.1

* cited by examiner

*Primary Examiner*—Kimberly R Lockett
(74) *Attorney, Agent, or Firm*—William W. Haefliger

(57) ABSTRACT

Multi-pivoted pedal drum beating apparatus, comprising a base, a swingable drum beater, a longitudinally extending pedal for swingably activating the beater, a first support for supporting the pedal to pivot at a first location, a second support for supporting the pedal to pivot at a second location, and the pedal being suspended by supports to pivot downwardly and optimally laterally during activation of the beater. Multiple axes of pivoting are defined by said apparatus.

16 Claims, 7 Drawing Sheets

109
112
102
107
104
8
100a
106
105
102a
103a
101
100
103
8

MULTI-PIVOTED PEDAL DRUM BEATING APPARATUS

BACKGROUND OF THE INVENTION

This invention relates generally to drum beating equipment, and more particularly to drum beaters and their pedal supports.

Drum beater pedals are used and operated to swingably drive the drum beater in response to downward displacement of the pedal. Pedal supports are employed to enable the pedal to swing downwardly and upwardly, with guiding, in response to displacement by the user's foot or shoe. Prior pedals were hinged to swing in a fixed arc relative to the pedal base, which in turn restricted movement of the user's shoe or foot to that arc, such restriction producing foot discomfort during repetitive pedal operation. There is need to "free-up" movement of the user's foot or shoe, as during repeated pedal downward swinging, to reduce or eliminate discomfort.

SUMMARY OF THE INVENTION

It is a major object of the invention to provide improved apparatus meeting the above need, and in such a way that pedal operation is not compromised. Basically, the apparatus of the invention comprises:

a) a base, b) a swingable drum beater, c) a longitudinally extending pedal for swingably activating the beater, d) a first support for supporting the pedal to pivot at a first location, e) a second support for supporting the pedal to pivot at a second location, and with lateral tile joint structure for guiding lateral tilt of the pedal, f) the pedal being suspended by said supports to pivot downwardly and optimally laterally during actuation of the beater.

As will be seen, the two locations are typically located proximate longitudinally spaced opposite ends of the pedal; and further, the first location is at or proximate the toe end of the pedal, and said second location is at or proximate the heel end of the pedal.

Another object includes provision of the first support means in the form of a flexible strap operatively connected to the pedal and to a rotor connected to the beater; and provision of the second support includes a universal joint suspending the heel end of the pedal in elevated position relative to the base. Accordingly, the pedal is enabled to tilt or swing laterally to accommodate to the user's foot or shoe movement or position, as for example when the user's leg is extended downwardly and laterally.

Yet another object includes provision of the universal joint to include a primary member connected to the pedal, and a secondary member connected to the base, the primary member pivotally supported to swing downwardly about a first axis extending generally laterally relative to the pedal, and about a second axis extending generally longitudinally relative to the pedal.

A further object includes provision of a positioning block to which said primary and secondary members are operatively connected, the block defining the first and second axes.

An additional object includes locating the secondary member to project upwardly relative to and above the base whereby the primary member is suspended spaced above the base during pedal swinging downwardly and laterally. In this regard, the positioning block is typically located to remain spaced above the base during pedal swinging, and it does not move laterally, whereby the heel end of the pedal is confined against lateral displacement, but is allowed to swing laterally about a longitudinal axis, acting to locate or guide the pedal during pedal movement.

Other objects include provision of pedal hinging structure, ball and socket lateral tilt joint structure; incorporation of lateral tilt structure in a pedal heel support; and use of a spring or springs to cushion lateral tilt of the pedal.

These and other objects and advantages of the invention, as well as the details of an illustrative embodiment, will be more fully understood from the following specification and drawings, in which:

DRAWING DESCRIPTION

Figure 6:
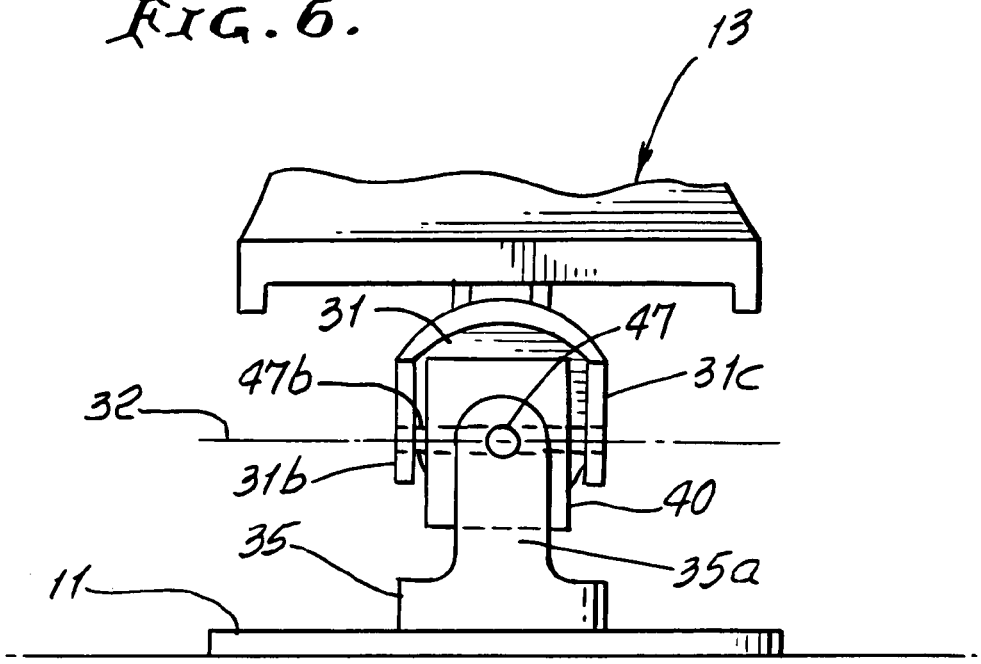
FIG. 6 is an end elevation taken on lines 6-6 of FIG. 1.
Figure 6A:
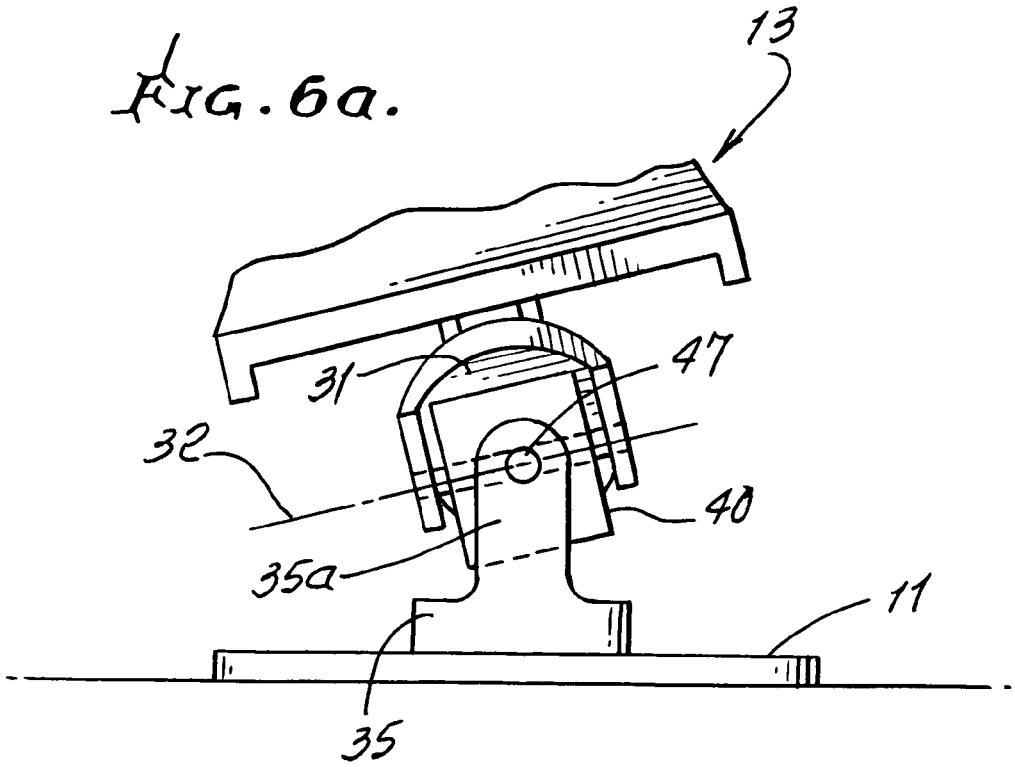

FIG. 6*a* shows pedal lateral pivoting; and

FIGS. 7-11 show modifications.

DRAWING DESCRIPTION

Figure 1:
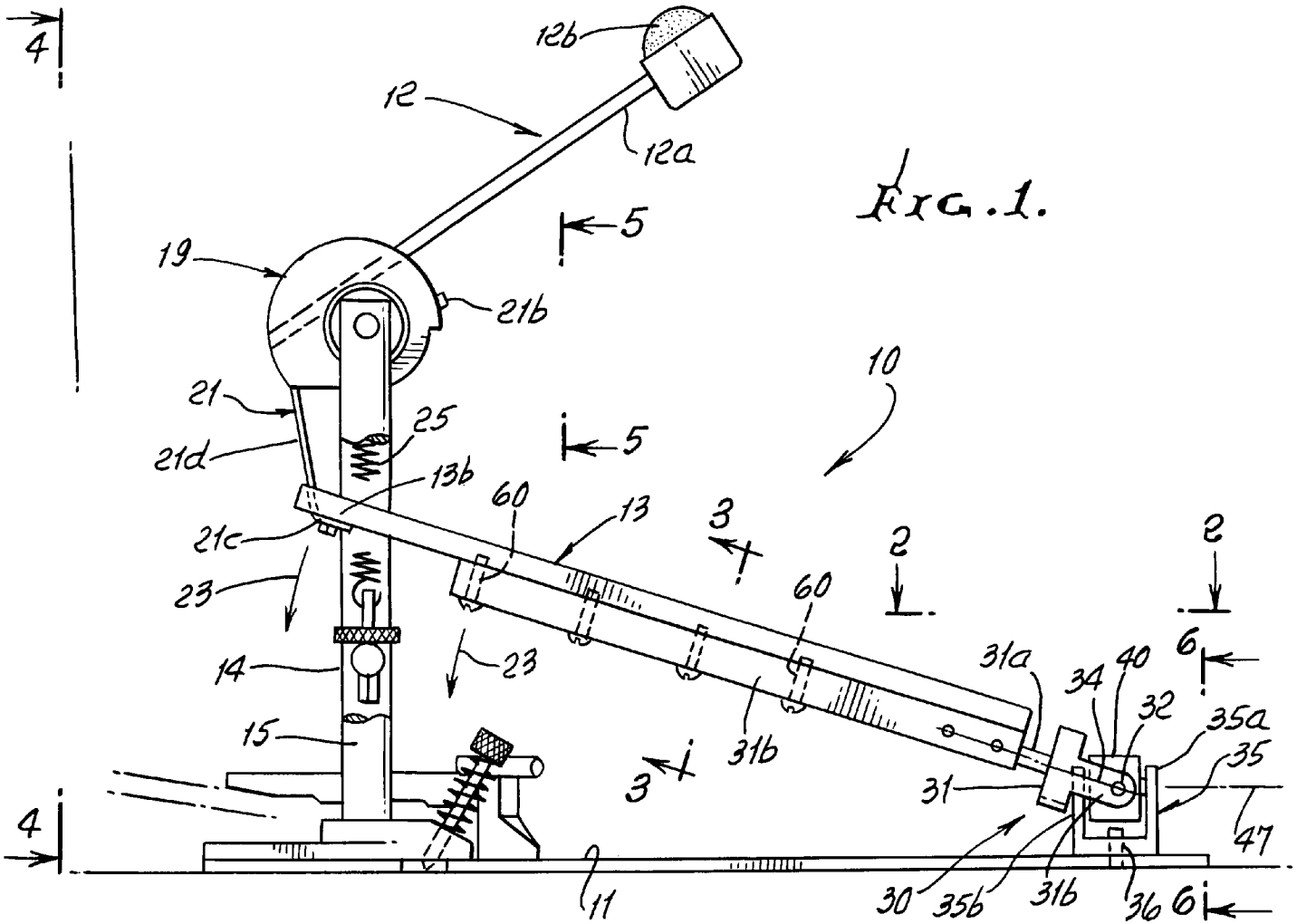
FIG. 1 is a side elevation showing a preferred form of the multi-pivoted pedal drum beating apparatus.
Figure 2:
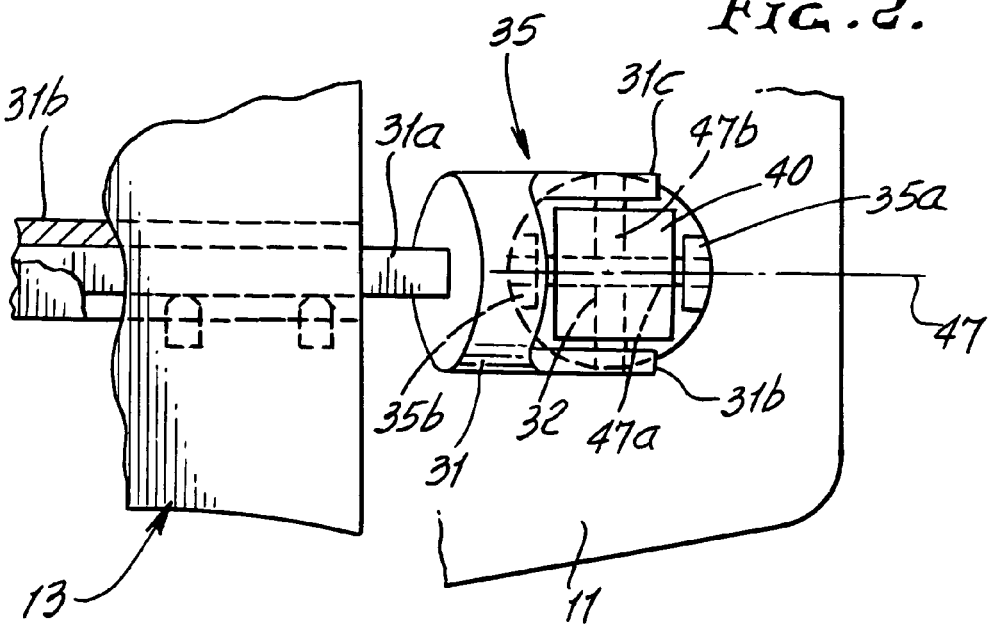
FIG. 2 is a plan view taken on lines 2-2 of FIG. 1.
Figure 3:
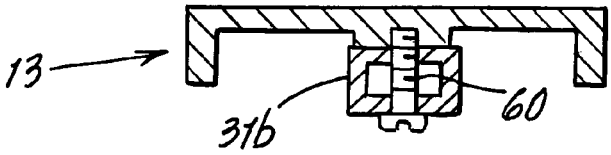
FIG. 3 is an elevation taken in section on lines 3-3 of FIG. 1.
Figure 5:
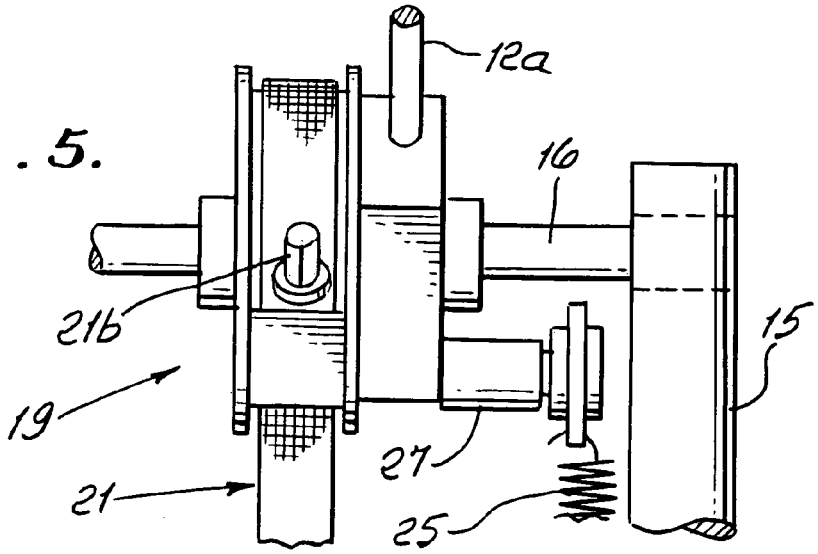
FIG. 5 is an elevation view taken on lines 5-5 of FIG. 1.

In FIG. 1 and other views the drum beating apparatus 10 includes a base 11 in the form of a horizontal plate, a swingable drum beater 12 having a rod 12*a* and beater ball 12*b*; and a longitudinally extending pedal 13 for swingably actuating the beater. Also shown are two laterally spaced uprights 14 and 15 attached to the base plate at 14*a* and 15*a*, and a horizontal axle 16 carried by the uprights at bearings 17 and 18. A rotor 19 is attached to the axle and carries an end of rod 12*a*. The rotor includes a rotation transmitting pulley 25 entraining the upper end 21*a* of a flexible belt 21, attached to the pulley at 21*b*. The lower end 21*c* of the belt is attached to the toe end 13*b* of the pedal, whereby when the pedal is depressed by the user's foot or shoe, in arrow direction 23, the belt will be translated to rotate the rotor 19, and swing the beater in the direction of a drum to strike the drum head.

Also provided is a tension spring 25 serving to yieldably resist rotor rotation, and to return the pedal to up position after the beater strikes the drum head. The lower end of the spring is attached to structure 26 attached to upright 14, and the upper end of the spring is attached to crank arm 27 projecting from the rotor, to be rotated and to extend the spring when the pedal is depressed.

In accordance with an important object of the invention, the pedal 13 is suspended by first and second supports to pivot both downwardly and optimally laterally during pivoting actuation of the beater, as referred to. The first such support is provided by the described suspension of the forward end of the pedal by the flexible belt 21. The belt flexibility allows optimal lateral pivoting and tilting of the pedal, as for example is shown in FIG. 6*a*, as controlled by the user's foot or shoe pressing down on the pedal to tilt it. Flanges 20*a* and 20*b* on the pulley retain the belt upper end therebetween by lateral or sideward confinement of the belt upper end. In effect, the belt twists or deflects in its mid-region 21*d* as the pedal tilts laterally, as described, but such twisting or deflecting is kept from deflecting the belt off the pulley, by the two flanges, at the entrained belt upper end extent.

The second pedal support is spaced longitudinally lengthwise of the pedal, and proximate the heel end of the pedal, and is generally designated at 30. It includes a universal joint suspending the heel end of the pedal at an elevated position relative to the base, to accommodate pedal lateral pivoting, above the base.

The joint includes a primary member 31 connected to the pedal as by strut 31*a* projecting longitudinally to an under brace 31*b* attached at 60 to the pedal underside, whereby elements 13, 31, 31*a* and 31*b* are integrally connected, to pivot laterally with the pedal, as about a longitudinal axis 34, parallel to pedal length.

Those elements also pivot downwardly with the pedal (see arrow 23), about a laterally extending axis 32, which pivots about axis 34. Axis 32 may be considered as a first axis, and axis 34 may be considered as a second axis.

A joint secondary member 35 projects upwardly relative to the base, to which it is rigidly connected at 36, whereby the primary member 31 is retained spaced above the base during pedal and primary member swinging, downwardly and laterally.

The universal joint also includes a block 40 to which the members 31 and 35 are operatively connected, and which defines lateral axis 32. The block defines a third axis 47 which extends horizontally forwardly, and about which the block is pivotable, as during pedal lateral pivoting about axis 34. Block 40 may have associated pivot pins 47*a* that pivot in bearings in flanges 35*a* and 35*b* of member 35, and about axis 47. Likewise, the block may have associated pivot pins 47*b* that pivot in bearings in arms or flanges 31*b* and 31*c* of member 31.

Accordingly, the three-axis universal joint, and the belt, accommodate the described swinging of plate 13 laterally and downwardly, the plate extending at an angle to horizontal. Also the use of the flexible belt prevents binding of plate bodily motion during pivoting of three axis universal joint elements; and the plate is held upwardly or suspended, despite forceful jamming downward repetitive motion transmitted to the plate by the drum player's foot. It will be understood that the second and third axes define an acute angle therebetween which varies in magnitude as the pedal pivots downwardly and upwardly.

Figure 4:
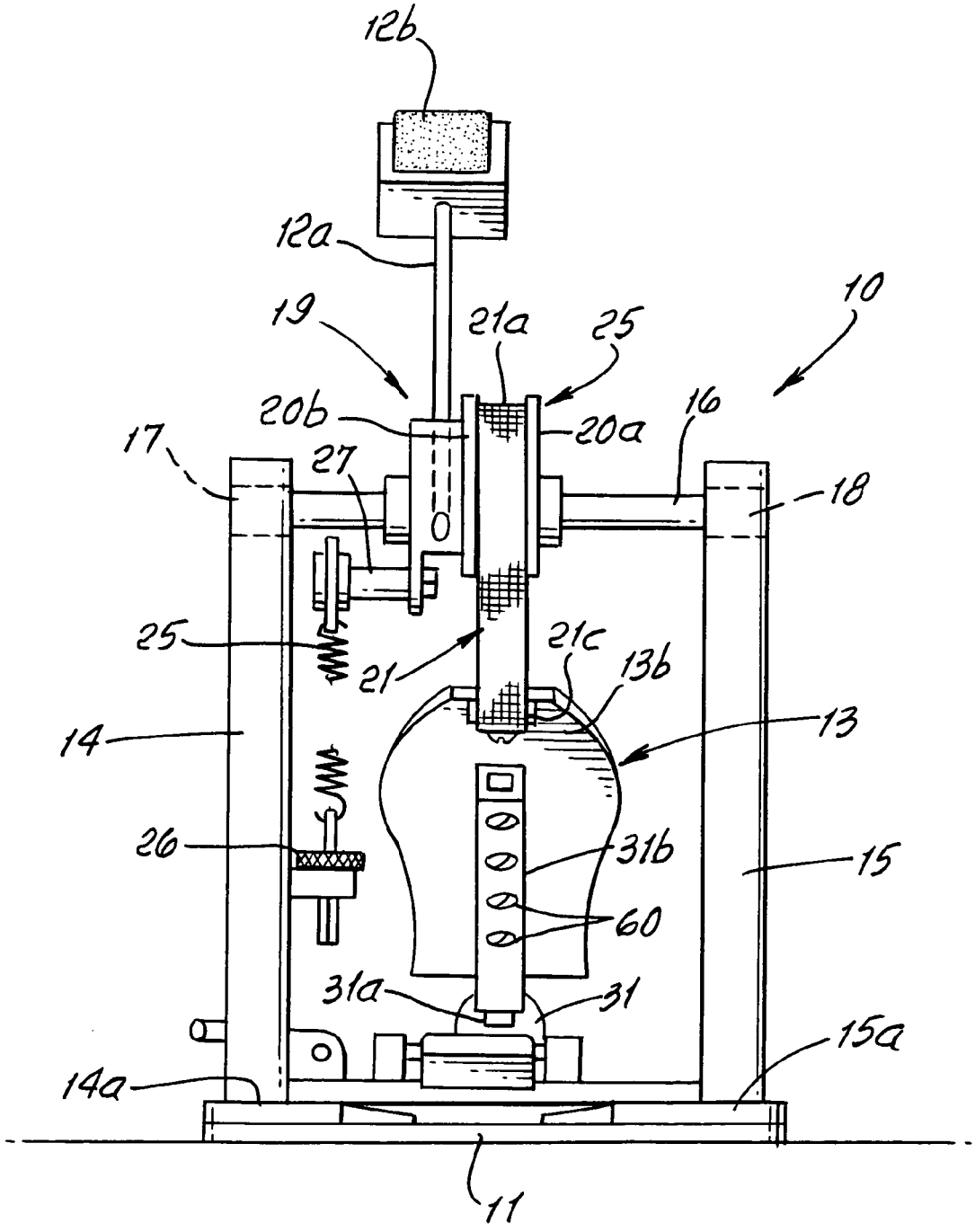
FIG. 4 is an elevation taken on lines 4-4 of FIG. 1.
Figure 7:
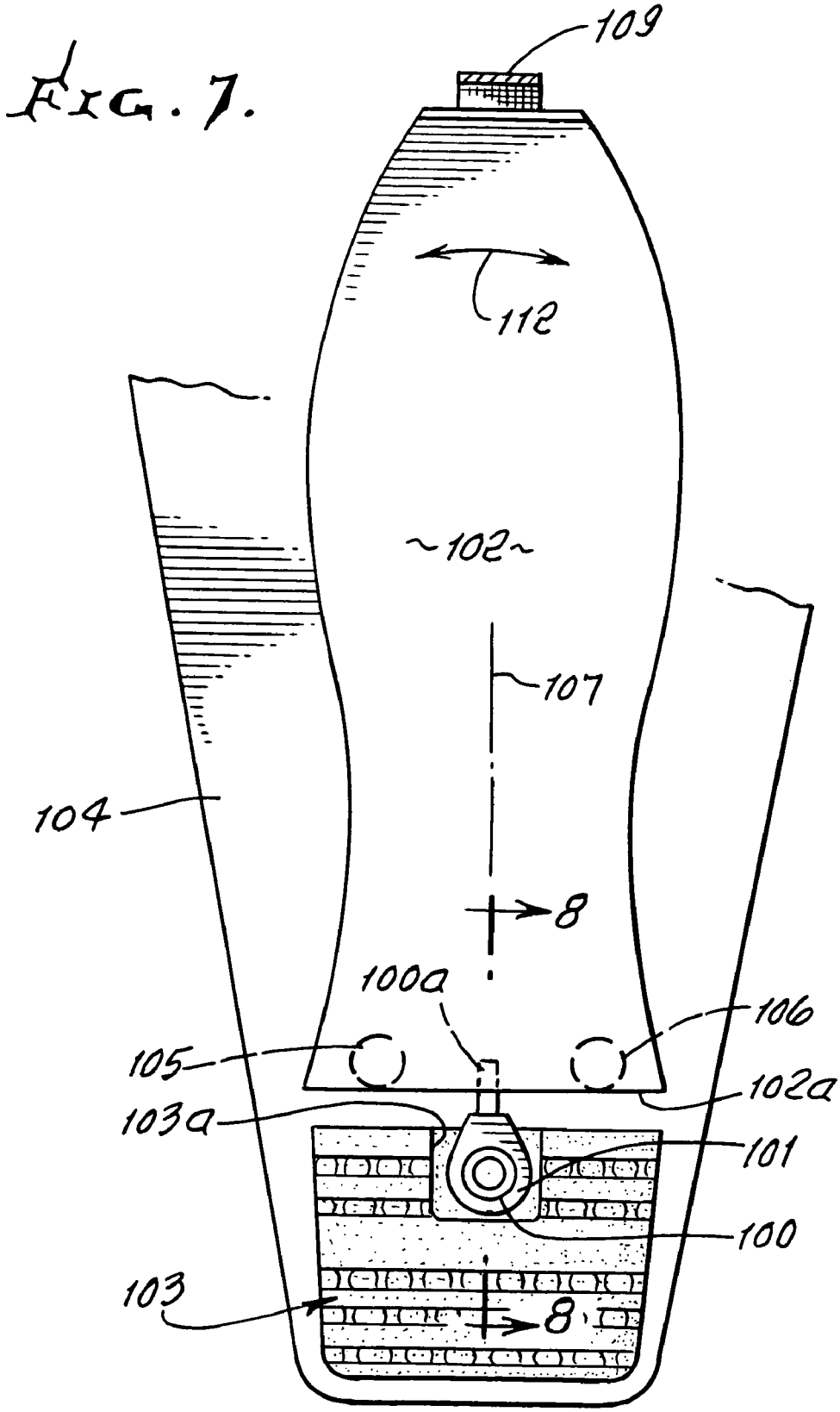
Figure 8:
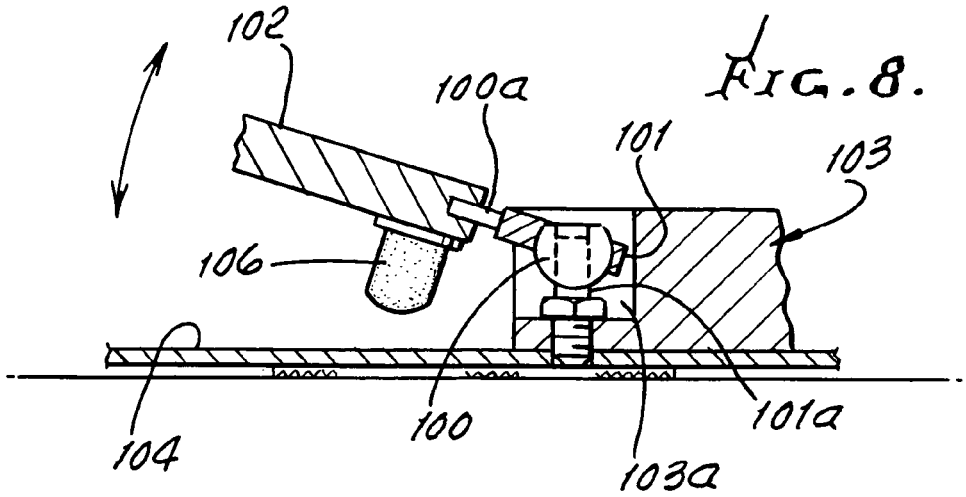
Figure 10:
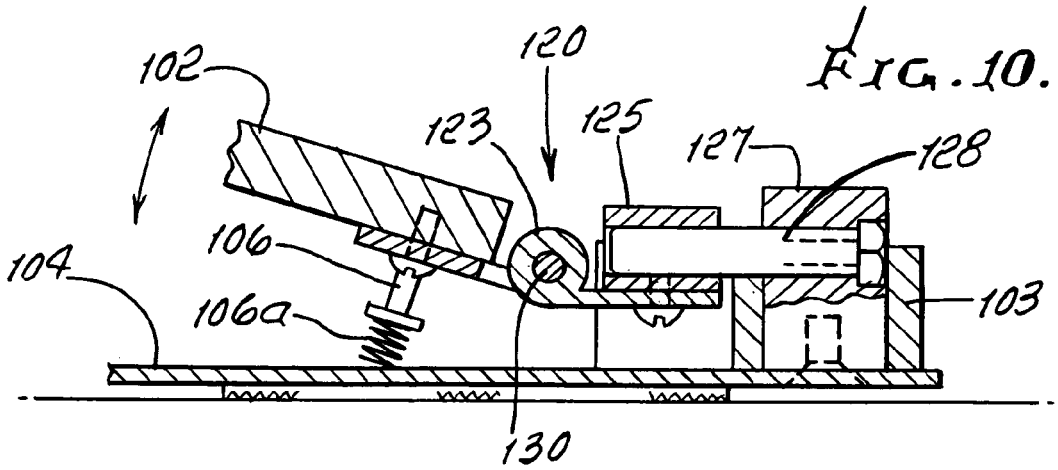

FIG. 7 is a rear view of a laterally tilting joint, such as a universal joint including a ball 100 and bearing cup 101, which allows and guides the pedal 102 to tilt leftwardly and rightwardly during up and down movement of the pedal 102. The ball has a stem 100*a* connected to the rear end 102*a* of the pedal; and the cup has a stem 101*a* connected to the user's heel support block 103, within a block recess 103*a*, as seen in FIGS. 7 and 8. Block is attached to floor plate 104. Stops 105 and 106 carried by the pedal project downwardly, at locations above plate 104, and they are offset from the pedal forward axis 107 to engage the floor plate and limit pedal flexible tilting. A flexible belt 109 is connected to the forward end of the pedal, and extends upwardly to a pulley or rotor 19 as in FIG. 4, to allow pedal tilting about axis 107 and pedal forward end sideward and selected deflection (see arrows 112). Springs 105*a* and 106*a* may be provided to engage plate 103 and cushion plate tilting.

Figure 9:
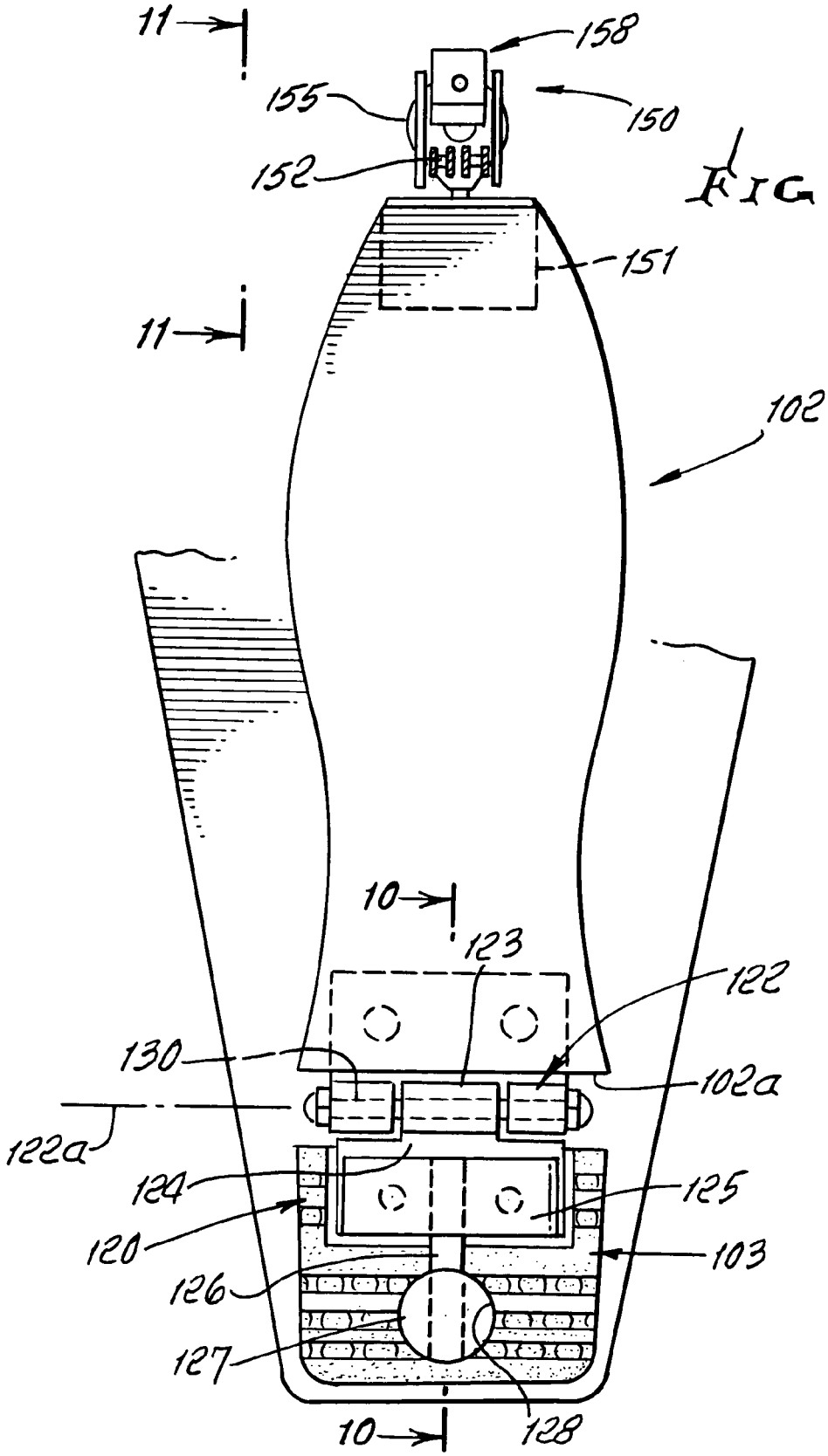

FIG. 9 is like FIG. 7, but shows a hinging structure 120 connected between the rear end of 102*a* of the pedal 102 and the block 103, allowing the pedal to tilt rightwardly and leftwardly during foot operated up and down movement of the pedal. Structure 120 includes a hinge 122 having a lateral axis 122*a* of pivoting, and outer cylinder 123 and a pivot pin 130 connected via struts 124 and 125 to a pivot end 126. The latter is connected to a ball 127 universally rotatable in a bearing 128 in block 103. Hinge outer cylinder 123 is connected at 123*a* to the rear end 102*a* of the pedal. Accordingly, the pedal rear end can pivot up and down as the pedal is moved by the user's foot; and can tilt laterally, clockwise or counterclockwise about axis 107. Stops 105 and 106 are provided as before.

Figure 11:
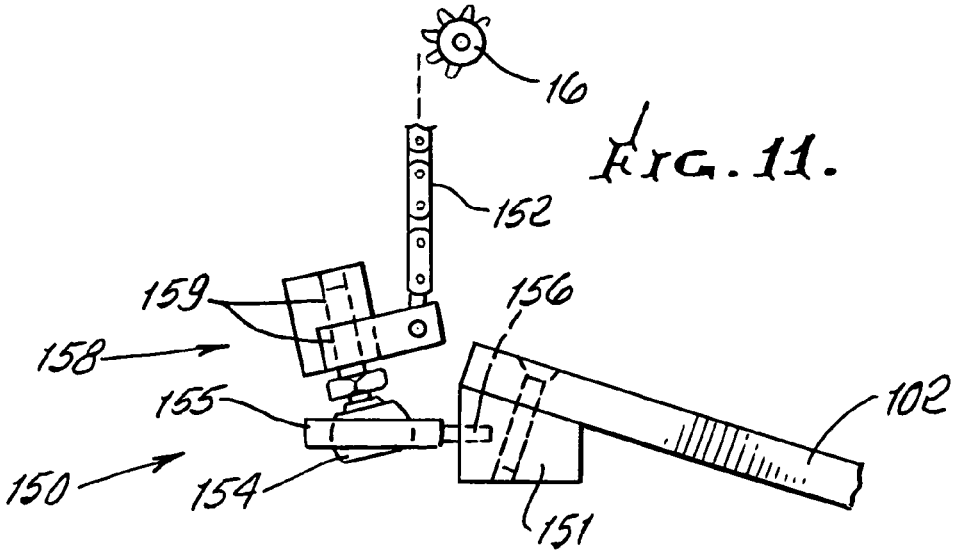

In FIG. 11, tilt mechanism 150 is shown between the forward end 151 of pedal 102 and a chain 152 that engages a sprocket 153 on axle 16, shown schematically. That mechanism includes a ball 154 tilting in a socket 155. The socket is carried at 156 by the pedal forward end 151, to tilt therewith. Ball 154 is connected at 158 by the lower end of the chain 52. Threaded adjuster 159 allows up or down Adjustment of the pedal end 151 relative to the chain.

I claim:

1. Multi-pivoted pedal drum beating apparatus, comprising, in combination:

a) a base, b) a swingable drum beater, c) a longitudinally extending pedal for swingably activating the beater, d) a first support for supporting the pedal to pivot at a first location, said first support including laterally tilting structure, e) a second support for supporting the pedal to pivot at a second location, said second support including a laterally tilting joint, f) the pedal being suspended by said supports to pivot downwardly and to tilt optimally laterally, as enabled by said tilting structure and joint, during activation of the beater.

2. The combination of claim 1 wherein said locations are located proximate longitudinally spaced opposite ends of the pedal.

3. The combination of claim 1 wherein said first location is at or proximate the toe end of the pedal, and said second location is at or proximate the heel end of the pedal.

4. The combination of claim 1 including a spring or springs positioned to cushion lateral tilting of the pedal.

5. The combination of claim 1 wherein at least two springs are provided to cushion left and right lateral tilting of the pedal.

6. The combination of claim 1 including stops carried by the pedal to engage the base and limit left and right tilting of the pedal.

7. The combination of claim 1 wherein said first support includes a chain, there being tilt mechanism operatively connected between the chain and pedal.

8. The combination of claim 1 wherein the tilt mechanism includes a ball and socket.

9. Multi-pivoted pedal drum beating apparatus, comprising, in combination:

a) a base, b) a swingable drum beater, c) a longitudinally extending pedal for swingably activating the beater, d) a first support for supporting the pedal to pivot at a first location, e) a second support for supporting the pedal to pivot at a second location, said second support including a laterally tilting joint, f) the pedal being suspended by said supports to pivot downwardly and optimally laterally, during activation of the beater, g) and wherein said first support includes a flexible strap operatively connected to the pedal and to a rotor connected to the beater.

10. Multi-pivoted pedal drum beating apparatus, comprising, in combination:

a) a base, b) a swingable drum beater, c) a longitudinally extending pedal for swingably activating the beater, d) a first support for supporting the pedal to pivot at a first location, e) a second support for supporting the pedal to pivot at a second location, said second support including a laterally tilting joint, f) the pedal being suspended by said supports to pivot downwardly and optimally laterally, during activation of the beater, g) and wherein the second support includes a universal joint structure suspending the heel end of the pedal in elevated position relative to the base.

11. The combination of claim 10 wherein the universal joint structure includes a primary member connected to the pedal, and a secondary member supported by the base, the primary member pivotally supported to swing downwardly about a first axis extending generally laterally relative to the pedal, and laterally about a second axis extending generally longitudinally relative to the pedal.

12. The combination of claim 11 wherein said secondary member projects upwardly relative to and above the base whereby the primary member is suspended spaced above the base during pedal swinging downwardly and laterally.

13. The combination of claim 11 wherein the universal joint includes a positioning block to which said primary and secondary members are operatively connected, the block attached to said base.

14. The combination of claim 13 wherein said secondary member projects upwardly relative to and above the base whereby the primary member is suspended spaced above the base during pedal swinging downwardly and laterally, and wherein said block remains positioned above the base during pedal swinging.

15. The combination of claim 13 wherein the universal joint includes a ball and socket.

16. The combination of claim 15 wherein said universal joint includes a hinge having a lateral axis and a ball and socket carried by the block which defines a surface to be engaged by the user's heel.

* * * * *